US012735848B2

(12) United States Patent
Rath

(10) Patent No.: US 12,735,848 B2
(45) Date of Patent: Sep. 15, 2026

(54) GROUND PROCESSING ROLLER

(71) Applicant: Hamm AG, Tirschenreuth (DE)

(72) Inventor: Günter Rath, Krummennaab (DE)

(73) Assignee: Hamm AG, Tirschenreuth (DE)

( * ) Notice: Subject to any disclaimer, the term of this patent is extended or adjusted under 35 U.S.C. 154(b) by 429 days.

(21) Appl. No.: 18/543,154

(22) Filed: Dec. 18, 2023

(65) Prior Publication Data

US 2024/0200286 A1 Jun. 20, 2024

(30) Foreign Application Priority Data

Dec. 19, 2022 (DE) ..... 10 2022 133 785.5

(51) Int. Cl.
*E01C 19/28* (2006.01)

(52) U.S. Cl.
CPC ..... *E01C 19/286* (2013.01)

(58) Field of Classification Search
CPC ..... E01C 19/286; E02D 3/026; F16H 57/04
USPC ..... 404/117
See application file for complete search history.

(56) References Cited

U.S. PATENT DOCUMENTS 3,722,381 A * 3/1973 Tuneblom ..... E01C 19/286 404/117
4,305,627 A * 12/1981 Yargici ..... F16C 33/6659 184/11.2
4,313,691 A * 2/1982 Yargici ..... E01C 19/282 404/117
6,386,794 B1 * 5/2002 Bitelli ..... B06B 1/165 404/117
8,556,039 B2 * 10/2013 Marsolek ..... F16C 3/02 184/6.12
12,578,056 B2 * 3/2026 Grove ..... F16C 33/6666

FOREIGN PATENT DOCUMENTS

CN 201180249 Y * 1/2009
CN 204551207 U * 8/2015
DE 1910031 U 2/1965
JP H06287908 A 10/1994
JP 6433654 B2 * 12/2018 ..... E02D 3/026

* cited by examiner

*Primary Examiner* — Gary S Hartmann
(74) *Attorney, Agent, or Firm* — RANKIN, HILL & CLARK LLP

(57) ABSTRACT

A ground processing roller includes a roller shell rotatable about a roller axis, a first lubricant sump arranged in a height direction below the roller axis, a second lubricant sump arranged in the height direction below the roller axis, and an overflow connection between the first lubricant sump and the second lubricant sump. Lubricant can flow from the second lubricant sump via the overflow connection into the first lubricant sump when the second lubricant sump level is reached or exceeded. The first lubricant sump is filled or fillable with lubricant up to a first lubricant sump level having a first distance from the roller axis in the height direction. The second lubricant sump is filled or fillable with lubricant up to a second lubricant sump level having a second distance from the roller axis in the height direction. The second distance is smaller than the first distance.

20 Claims, 5 Drawing Sheets

GROUND PROCESSING ROLLER

BACKGROUND

The present invention relates to a ground processing roller which can be used to compact a soil, such as asphalt, for example.

To be able to achieve a higher and more uniform degree of compaction, in particular when compacting asphalt, it is known to use ground processing rollers to carry out such compaction processes, which have an unbalance arrangement with a plurality of unbalanced masses arranged at a circumferential distance from one another about the roller axis of rotation, wherein each unbalanced mass can be driven to rotate about an unbalance axis of rotation assigned thereto. Due to the rotation of these unbalanced masses, depending on the phase position and direction of rotation of the unbalanced masses or the centers of mass thereof relative to one another, a substantially tangentially acting oscillation torque can be superimposed on the rotational movement of such a ground processing roller about the roller axis of rotation in oscillatory operation, or a force which is substantially orthogonal to the roller axis of rotation can be applied to the ground processing roller in vibration operation.

The various components provided to achieve such an oscillatory operation or vibration operation are substantially positioned and movable in a roller interior of such a ground processing roller, which interior is surrounded by a roller shell. In order to provide sufficient lubrication for these rotating or/and torque-transmitting components, which are rotatably mounted in different bearing areas, it is necessary to provide lubricant or a lubricant circulation in the roller interior.

SUMMARY

It is the object of the present invention to provide a ground processing roller, in particular for a soil compactor, in which reliable lubrication of components provided in different radial areas with respect to a roller axis of rotation of the ground processing roller in a roller interior is achieved.

According to the invention, this object is achieved by a ground processing roller, in particular for a soil compactor, comprising:

- a roller shell that can be rotated about a roller axis of rotation and surrounds a roller interior,
- an unbalance arrangement with a plurality of unbalanced masses arranged at a circumferential distance from one another about the roller axis of rotation, wherein each unbalanced mass can be driven to rotate about an unbalance axis of rotation assigned thereto,
- an unbalance drive with an unbalance motor and an unbalance transmission system, wherein the unbalance transmission system comprises at least one drive gear that can be driven for rotation by the unbalance motor and, in assignment to each unbalanced mass, a driven gear connected thereto for common rotation, wherein each drive gear is coupled to at least one driven gear for torque transmission,
- a first lubricant sump arranged in a height direction below the roller axis of rotation, wherein the first lubricant sump is filled or fillable with lubricant up to a first lubricant sump level which has a first distance from the roller axis of rotation in the height direction,
- a second lubricant sump arranged in a height direction below the roller axis of rotation, wherein the second lubricant sump is filled or fillable with lubricant up to a second lubricant sump level which has a second distance from the roller axis of rotation in the height direction, wherein the second distance is smaller than the first distance,
- a lubricant conveying arrangement for conveying lubricant from the first lubricant sump into the second lubricant sump,
- an overflow connection between the first lubricant sump and the second lubricant sump, wherein lubricant flows from the second lubricant sump via the overflow connection into the first lubricant sump in the conveying operation of the lubricant conveying arrangement when the second lubricant sump level is reached or exceeded in the second lubricant sump.

Providing two radially staggered lubricant sumps creates the option in the area of the radial levels covered by these lubricant sumps to wet components located there or moving through these areas with lubricant and thus to protect them from excessive stress or aging. At the same time, this radial staggering of the lubricant sumps and the conveyance of lubricant from the first lubricant sump into the second lubricant sump as well as the option to release excess lubricant from the second lubricant sump back into the first lubricant sump results in a cascade-like arrangement of the lubricant sumps with a guided circulation of the lubricant therethrough. Thus, while using a comparatively small amount of lubricant overall and thus avoiding the need to fill the interior of the roller with excess lubricant, system areas positioned at different radial distances from the roller axis of rotation can be reliably supplied with the amount of lubricant required for their lubrication.

For low-wear and reliable torque transmission, at least one drive gear, preferably each drive gear, can be in meshing engagement with at least one driven gear, or/and at least one driven gear, preferably each driven gear, can be connected to the unbalanced mass assigned to it for common rotation about the unbalance axis of rotation of this unbalanced mass. To be able to generate the operative direction tangential or orthogonal to the roller axis of rotation by means of the unbalance arrangement, it is proposed that the unbalance axis of rotation of at least one unbalanced mass, preferably each unbalanced mass, is eccentric or/and parallel to the roller axis of rotation. This leads to efficient lubrication of components arranged in different height areas or radial levels with respect to the roller axis of rotation using a comparatively small amount of lubricant and thus avoids the need to fill the roller interior with an excessively large amount of lubricant.

To be able to collect lubricant conveyed or distributed upwards from the first lubricant sump by the lubricant conveying arrangement and to direct it into the second lubricant sump, it is proposed that a lubricant collecting unit, which is open at the top in the height direction, is provided above the roller axis of rotation, and that a lubricant flow connection is provided between the lubricant collecting unit and the second lubricant sump for directing lubricant collected in the lubricant collecting unit into the second lubricant sump.

For an efficient collecting effect, the lubricant collecting unit can comprise a trough-like lubricant collecting element, which preferably widens like a funnel in the vertical direction.

The roller shell can be rotatably supported on a support arrangement about the roller axis of rotation, wherein the support arrangement comprises a rotatable support arrangement part which is non-rotatably connected to the roller shell and a fixed support arrangement part which rotatably supports the rotatable support arrangement part. The first lubricant sump and the second lubricant sump can be provided in a support arrangement interior formed in the support arrangement. This creates the option of providing the two lubricant sumps in the two support arrangement parts closed to prevent the escape of lubricant to the outside.

To achieve efficient use of the interior space provided in the support arrangement, it is proposed that the first lubricant sump is substantially completely provided in the rotatable support arrangement part, or/and that the second lubricant sump is substantially completely provided in the fixed support arrangement part.

For force transmission coupling or torque transmission coupling with the roller shell, the unbalanced masses can be carried rotatably about their unbalanced axes of rotation on the rotatable support arrangement part on which the roller shell is also supported.

The at least one drive gear and the driven gears can be arranged in a first region of the support arrangement interior formed substantially in the rotatable support arrangement part. This makes it possible, particularly if the first lubricant sump is also provided in this area, to position a driven gear positioned in the height direction below the roller axis of rotation at least partially in the first lubricant sump. In this context, it should be noted that, when the ground processing roller rotates about its roller axis of rotation, the unbalanced masses also move with their unbalanced axes of rotation about the roller rotation axis and thereby successively reach such a position under the roller rotation axis and in the first lubricant sump.

To ensure that the lubricant collecting unit is always positioned in an area that is in an upper area in the height direction or an area located above the roller axis of rotation, it is proposed that the lubricant collecting unit is provided on the fixed support arrangement part, and that the lubricant flow connection is in the fixed support arrangement part or/and is formed substantially in the second region of the support arrangement interior formed in the fixed support arrangement part.

To be able to easily provide a flow connection between the two lubricant sumps, it is proposed that a limiting element delimiting the second lubricant sump in the direction of the roller axis of rotation is provided on the fixed support arrangement part, and that at least one lubricant passage opening of the overflow connection is provided in the limiting element.

To easily enable drive access to the at least one drive gear, the roller axis of rotation can pass through the lubricant passage opening or/and the lubricant passage opening can be arranged substantially concentrically to the roller axis of rotation.

To drive the unbalanced masses, the unbalance transmission system can comprise two drive gears and an unbalance transmission unit, wherein at least one of the drive gears can be driven to rotate by the unbalance motor via the unbalance transmission unit.

In a particularly advantageous embodiment, one of the drive gears can be driven by the unbalance motor via the unbalance transmission unit to rotate about a drive gear axis of rotation that is preferably concentric with the roller axis of rotation, and another of the drive gears can be driven directly by the unbalance motor to rotate about the drive gear axis of rotation. In this context, it should be noted that a direct drive connection means that the drive gear driven in this way is coupled to a drive element of the unbalance motor for common rotation without the option of rotational speed transmission or reversal of the direction of rotation or change of the phase position, for which purpose, for example, a torque-transmitting shaft or the like can be used.

The unbalance transmission unit can be designed as a rotational position adjustment gear, wherein the unbalance transmission unit can adjust a rotational position of one of the drive gears about the drive gear axis of rotation with respect to a rotational position of the other of the drive gears about the drive gear axis of rotation. For example, the unbalance transmission unit can include a planetary gear. In such a configuration, there preferably is also no change in rotational speed caused by the unbalance transmission unit itself or that the drive gear driven to rotate by said transmission unit rotates at the same speed as the drive gear driven directly by the unbalance motor. Only in a phase in which a change in the relative rotational position of the two drive gears is to be effected, it is inevitable they temporarily have different speeds.

For a compact design, the unbalance transmission unit can be arranged in a second region of the support arrangement interior which is substantially formed in the fixed support arrangement part.

To be able to lubricate in particular the unbalance transmission unit or components thereof by means of the second lubricant sump, a part of the unbalance transmission unit positioned in the height direction below the roller axis of rotation can be positioned at least partially in the second lubricant sump. It should also be taken into account that during operation, due to the movement of components of the unbalance transmission unit about the roller axis of rotation, they periodically reach the area of the second lubricant sump and can be wetted with lubricant there.

For a lubricant conveying arrangement that is simple to design but still operates efficiently, this can include at least one driven gear, preferably all driven gears, or/and at least one drive gear, preferably all drive gears.

For an efficient conveying effect, the lubricant conveying arrangement can further comprise a plurality of conveying projections provided on the rotatable support arrangement part.

The invention further relates to a ground processing machine, preferably a soil compactor, comprising at least one ground processing roller constructed according to the invention.

BRIEF DESCRIPTION OF THE DRAWINGS

The present invention is described in detail below with reference to the attached drawings. Wherein.

DETAILED DESCRIPTION

Figure 1:
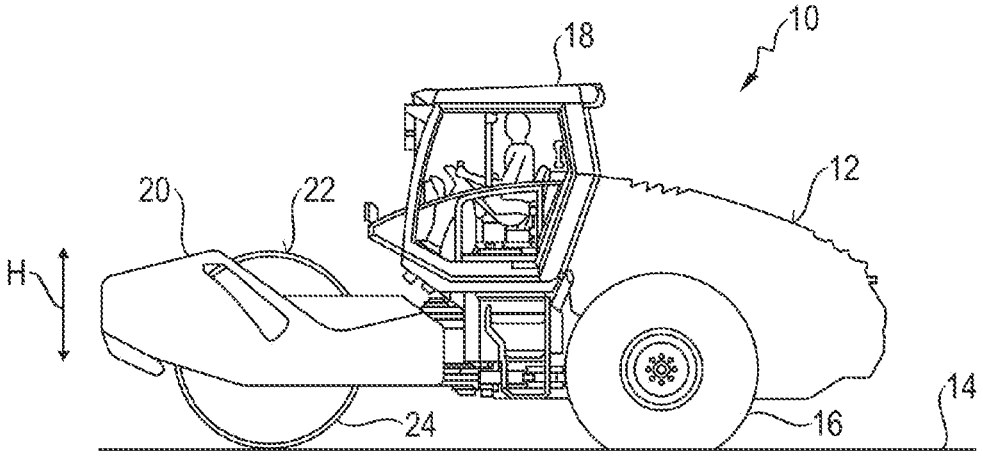
FIG. 1 shows a side view of a ground processing machine configured as a soil compactor.

In FIG. 1, a ground processing machine configured as a soil compactor is generally designated by 10. The ground processing machine 10 comprises a rear carriage 12 on which a drive unit and drive wheels 16 which can be driven thereby for moving the ground processing machine 10 on a surface 14 are provided. A control station, generally designated 18, is also provided on the rear carriage 12, from which an operator can control the ground processing machine 10.

A front carriage, generally designated 20, is articulated to the rear carriage 12. On the front carriage 20, a ground processing roller 22 is rotatably supported about a roller axis of rotation which is orthogonal to the drawing plane of FIG. 1. The front carriage 20 surrounds the ground processing roller 22 like a frame. In its two axial end regions, the ground processing roller 22 is supported, for example, via elastic suspensions on the front carriage 20.

It should be noted that the ground processing machine 10 shown in FIG. 1 only illustrates an example of such a ground processing machine. For example, in the case of a ground processing machine, a ground processing roller could also be provided on the rear carriage 12, and in particular in the case of a design with two ground processing rollers, at least one, preferably each, ground processing roller can be driven to rotate in order to move the ground processing machine 10 forward on the surface 14. Also in the ground processing machine 10 shown in FIG. 1, the ground processing roller 22 can be driven to rotate about its roller axis of rotation by a roller drive motor assigned to it. However, the movement of the ground processing machine 10 over the surface 14 can also be generated solely by driving the drive wheels 16.

FIGS. 2 to 5 show the structure of a ground processing roller 22 that can be used in the ground processing machine 10. The ground processing roller 22 comprises a cylindrical roller shell 24 surrounding the roller axis of rotation W of the same, which surrounds a roller interior 26 or closes it radially outwards.

An unbalance arrangement, generally designated 28, is provided in the roller interior 26. In the exemplary embodiment shown, the unbalance arrangement 28 comprises two unbalanced masses $\mathbf{30}_1$, $\mathbf{30}_2$ arranged at a circumferential distance from one another about the roller axis of rotation W or arranged opposite one another with respect to the roller axis of rotation W. Each of the unbalanced masses $\mathbf{30}_1$, $\mathbf{30}_2$ is rotatable about an unbalance axis of rotation U which is parallel to the roller axis of rotation W and eccentric thereto, wherein the unbalanced axes of rotation U of the unbalanced masses $\mathbf{30}_1$, $\mathbf{30}_2$ preferably have the same radial distance from the roller axis of rotation W. The unbalanced masses $\mathbf{30}_1$, $\mathbf{30}_2$ can be driven to rotate about the respective unbalance axis of rotation U, such that a center of mass M of the unbalanced masses $\mathbf{30}_1$, $\mathbf{30}_2$, which is located eccentrically with respect to the respective unbalance axis of rotation U, rotates about the respectively assigned unbalance axis of rotation U.

The unbalanced masses $\mathbf{30}_1$, $\mathbf{30}_2$ of the unbalance arrangement 28 are rotatably supported in the roller interior 26 at their two axial end regions via respective bearing arrangements 36, 40. For this purpose, two support rings 32, 34 are provided in the roller interior 26, which rings are arranged at an axial distance from one another along the roller axis of rotation W and are fixed to the inside of the roller shell 24, for example by welding, and are generally also referred to as blanks. The unbalanced masses $\mathbf{30}_1$, $\mathbf{30}_2$ are rotatably supported on the support ring 34 shown on the right in FIG. 2 via bearing units 36 on a support disc 38 fixed to the support ring 34 by a screwed connection, for example. At the end regions visible on the left in FIG. 2, the unbalanced masses $\mathbf{30}_1$, $\mathbf{30}_2$ are rotatably supported via respective bearing units 40 on a support arrangement 42 described in detail below, particularly with reference to FIG. 4.

Figure 4:
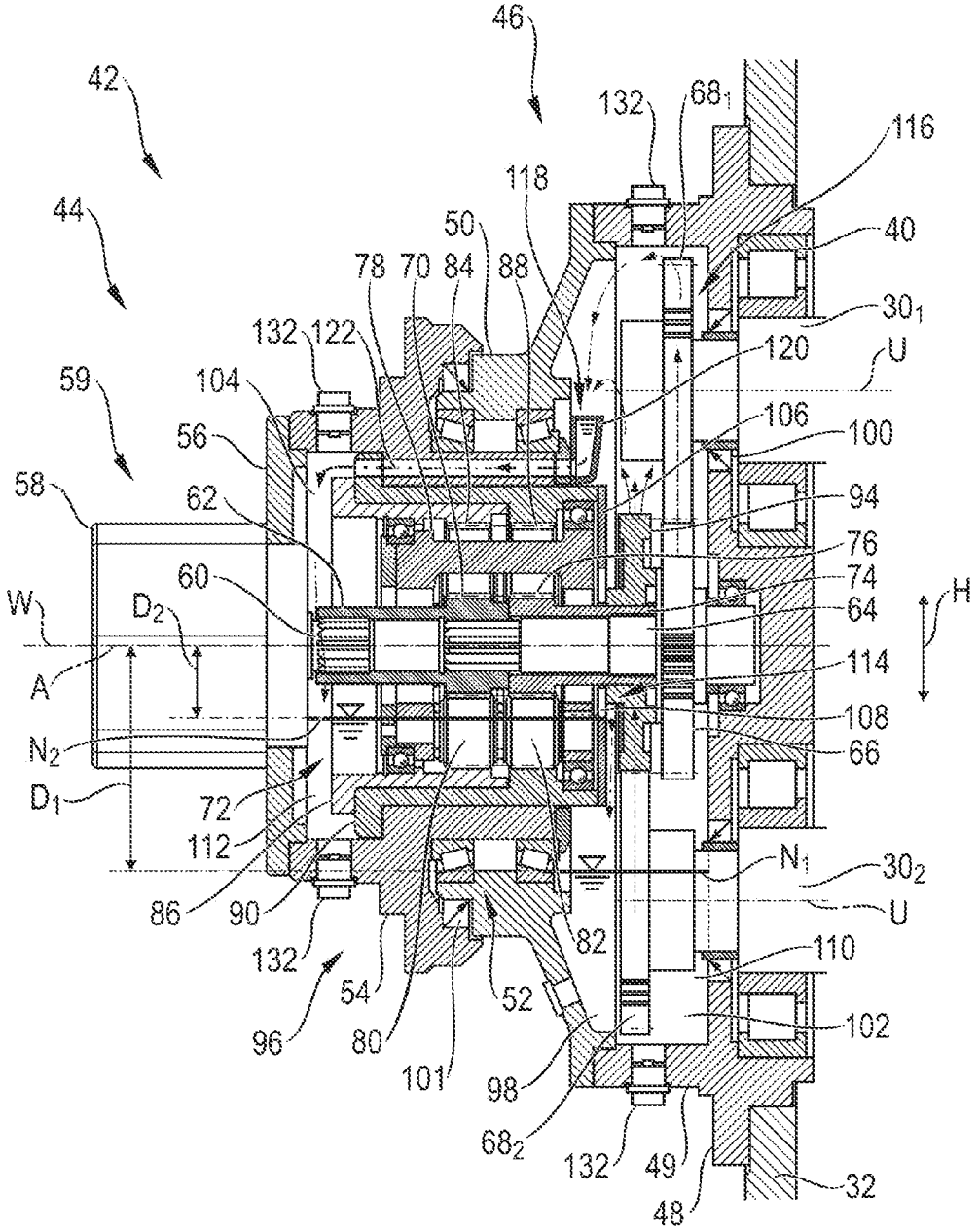
FIG. 4 enlarges detail IV in FIG. 2.

The support arrangement 42, which can be seen in more detail in FIG. 4, comprises a fixed support arrangement part, generally designated 44, which can be supported on the front carriage 20, for example, via an elastic suspension already mentioned above. The fixed support arrangement part 44 is therefore not rotatable about the roller axis of rotation W. The support arrangement 44 further includes a rotatable support arrangement portion, generally designated 46, which rotates about the roller axis of rotation W when the ground processing roller 22 rotates.

The rotatable support arrangement part 44 comprises a substantially disc-like housing part 48, which is fixed in its radially outer region, for example by screwing, to the support ring 32 and on which the unbalanced masses $\mathbf{30}_1$, $\mathbf{30}_2$ are rotatably supported via the bearing units 40.

On a cylindrical extension 49 of the housing part 48, another substantially disk-like housing part 50 of the rotatable support arrangement part 46 is fixed in its radially outer region, for example by screwing. At its radially inner region, the housing part 50 is rotatably mounted about the roller axis of rotation W via a bearing unit generally designated 52 on a substantially ring-like housing part 54 of the fixed support arrangement part 44, which is elongated in the direction of the roller axis of rotation W.

An unbalance motor 58 of an unbalance drive 59 is carried on an end cover 56 fixed to the housing part 54 of the fixed support arrangement part 44, for example by screwing. The unbalance motor 58 can be, for example, a hydraulic motor or electric motor, which drives the unbalance masses $\mathbf{30}_1$, $\mathbf{30}_2$ to rotate about their respective unbalance axes of rotation U by means of a drive member 60, for example a drive pinion, in the manner described below.

A first hollow shaft 62 is in meshing engagement with the drive member 60, such that the first hollow shaft 62 can be driven by the drive member 60 to rotate about the roller axis of rotation W. A drive shaft 64 meshes with the first hollow shaft 62 and carries a first drive gear 66 at its axial end region remote from the hollow shaft 62 and is rotatably mounted on the housing part 48 of the rotating support arrangement part 46. The first drive gear 66 is in meshing engagement with a driven gear 681 assigned to the unbalanced mass $\mathbf{30}_1$ or connected to it for common rotation about its unbalance axis of rotation U. The first drive gear 66, which is coupled to the unbalance motor 58 via the first hollow shaft 62 and the drive shaft 64 directly for rotation about a drive gear axis of rotation A corresponding to the roller axis of rotation W, drives the unbalanced mass $\mathbf{30}_1$ to rotate.

The first hollow shaft 62 forms, at its axial end distal from the unbalance motor 58 and coupled to the drive shaft 64 for common rotation, a first sun gear 70 of an unbalance transmission unit designed as a planetary gear and generally designated 72. On a second hollow shaft 74 surrounding the drive shaft 64, a second sun gear 76 of the unbalance transmission unit 72 is formed at its axial end adjacent to the first sun gear 70.

Sets of planet gears 80, 82 which are axially adjacent to one another and are each assigned to the two sun gears 70, 76 are rotatably supported on a planetary gear support 78 which surrounds the roller axis of rotation W in a ring-like manner. The set of planet gears 70, which are in meshing engagement with the first sun gear 70, is assigned a first ring gear element 86 that surrounds them and provides a first ring gear element 84. The planet gears 82, which are in meshing engagement with the second sun gear 76, are assigned a second ring gear 88, which is in meshing engagement with them, on a second ring gear element 90. While the second ring gear element 90 is firmly, in particular non-rotatably, supported on the housing part 54 of the fixed support arrangement part 44, the first ring gear element 86 is rotatably supported in the second ring gear element 90 by an actuator 92 indicated in FIG. 5 about the roller axis of rotation W with respect to the second ring gear element 90. The actuator 92 can, for example, comprise a worm gear drive that interacts with the first ring gear element 86.

A second drive gear 94 is non-rotatably connected to the second hollow shaft 74 at its axial end distal from the second sun gear 76. The second drive gear 94 lies axially directly next to the first drive gear 66 and is in meshing engagement with a drive gear 682 assigned to the unbalanced mass $\mathbf{30}_2$.

If the first hollow shaft 62, which also directly drives the drive shaft 64, is driven by the unbalance motor 58 to rotate about a drive gear axis of rotation A corresponding to the roller axis of rotation W, then due to the fact that, in the illustrated embodiment of the unbalance transmission unit 72, the two sun gears 70, 76, the two ring gears 84, 88, and also the planet gears 80, 82 each have the same diameter, the rotation of the drive member 60 is transmitted to the second drive gear 94 without changing the rotational speed, which second drive gear drives the unbalanced mass $\mathbf{30}_2$ to rotate at the same speed and direction of rotation with which the unbalanced mass $\mathbf{30}_1$ rotates.

If the phase position of the unbalanced masses $\mathbf{30}_1$, $\mathbf{30}_2$ rotating at the same speed is to be changed with respect to one another, the first ring gear element 86 is rotated about the roller axis of rotation W, which in the course of this rotational movement leads to a change in the speed of the second hollow shaft 74 with respect to the speed of the first hollow shaft 62 and accordingly also a temporary change in the speed of the unbalanced mass $\mathbf{30}_2$ driven via the second drive gear 94. This leads to a change in the phase position of the center of mass M of the unbalanced mass $\mathbf{30}_2$ with respect to the phase position of the center of mass M of the unbalanced mass $\mathbf{30}_1$. If the desired extent of the change in phase position is reached, the rotational movement of the first ring gear element 84 is stopped, such that both unbalanced masses $\mathbf{30}_1$, $\mathbf{30}_2$ then rotate again at the same speed.

Figure 2:
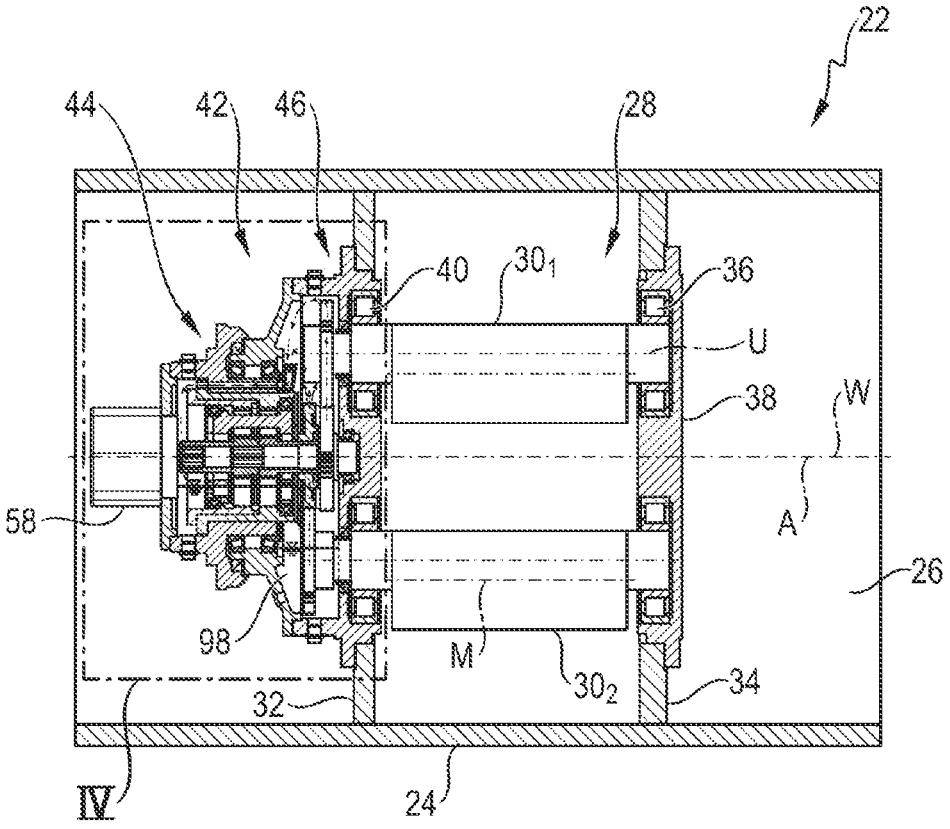
FIG. 2 is a longitudinal sectional view of a ground processing roller that can be used in the ground processing machine of FIG. 1.
Figure 9:
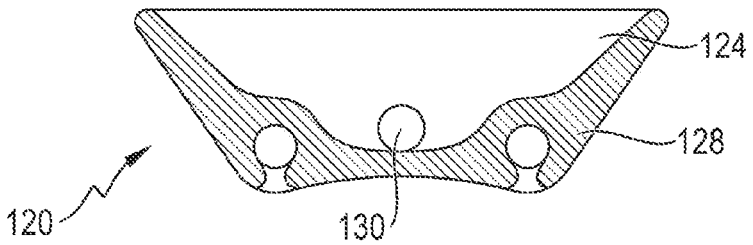
FIG. 9 is a longitudinal sectional view of the lubricant collecting element of FIG. 6, cut along a line IX-IX in FIG. 8.
Figure 10:
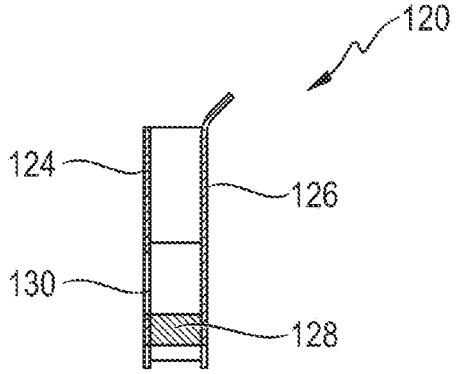
FIG. 10 is a cross sectional view of the lubricant collecting element of FIG. 6, cut along a line X-X in FIG. 7.
Figure 3:
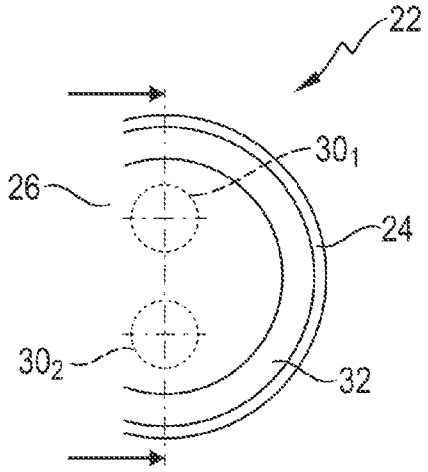
FIG. 3 is an axial view of the ground processing roller of FIG. 2, illustrating the sectional plane of FIG. 2.

By adjusting the phase position of the centers of mass M of the two unbalanced masses $\mathbf{30}_1$, $\mathbf{30}_2$, it becomes possible to switch the unbalance arrangement 28 between different operating states. The two unbalanced masses $\mathbf{30}_1$, $\mathbf{30}_2$ are arranged in such a way that, as can be seen in FIG. 2, their centers of mass M have the same phase position and thus the force vectors that occur in the unbalanced masses $\mathbf{30}_1$, $\mathbf{30}_2$ and are orthogonal to the respective unbalance axis of rotation U are parallel to one another and are oriented in the same way, these forces add up constructively, such that in every rotational position of the unbalanced masses $\mathbf{30}_1$, $\mathbf{30}_2$ a force orthogonal to the roller axis of rotation W acts on the ground processing roller 22 and the unbalance arrangement 28 thus works in a vibration operation. If the phase position of the centers of mass M is changed by 180° by relative rotation of the unbalanced masses $\mathbf{30}_1$, $\mathbf{30}_2$ from the positioning shown in FIG. 2, such that a phase offset of the centers of mass M of the unbalanced masses $\mathbf{30}_1$, $\mathbf{30}_2$ of 180° develops, the forces occurring on the unbalanced masses $\mathbf{30}_1$, $\mathbf{30}_2$ during rotational operation of the same are such that a torque periodically changing direction is exerted on the ground processing roller 22 about the roller axis of rotation W. In this state, the unbalance arrangement 28 is operated in an oscillation operation. By changing the phase position of the centers of mass M of the unbalanced masses $\mathbf{30}_1$, $\mathbf{30}_2$ between the two previously mentioned relative positionings by acting on the unbalance transmission unit 72, the unbalance arrangement 28 can thus be switched between a vibration operation and an oscillation operation.

It should be noted that the unbalance arrangement 28 can also be constructed with a different number of unbalanced masses. For example, four unbalanced masses can be provided with an angular distance of 90° with respect to each other about the roller axis of rotation W, wherein unbalanced masses diametrically opposite one another with respect to the roller axis of rotation W each form a pair of unbalanced masses, in which the two unbalanced masses are rotated together by one of the two drive gears, i.e. for joint rotation at the same speed and in the same direction of rotation. By acting on the unbalance transmission unit 72, the phase position of the centers of mass of the two pairs of unbalanced masses can be changed with respect to one another, which makes it possible to vary the size and orientation of a force oriented substantially orthogonally to the roller axis of rotation W in the vibration operation of the unbalanced arrangement 28 during rotational operation of the unbalanced masses.

To achieve this rotational movement of the unbalanced masses $\mathbf{30}_1$, $\mathbf{30}_2$, the unbalance transmission unit 72, the drive gears 66, 94 and the driven gears 681, 682 driven by them to rotate form an unbalance transmission system of the unbalance drive 59, generally designated 96. To protect the various components of this unbalance transmission system 96 which are rotating and in meshing engagement with one another and also to protect the bearing units supporting these components from excessive wear, liquid lubricant, for example oil or the like, is contained in a support arrangement interior 98 formed in the support arrangement 42. In order to seal this support arrangement interior 98 against the escape of lubricant, on the one hand the unbalanced masses $\mathbf{30}_1$, $\mathbf{30}_2$ are assigned sealing units 100 which seal against the escape of fluid with respect to the housing part 48 of the rotating support arrangement part 46. The rotating support arrangement part 46 is tightly sealed with respect to the fixed support arrangement part 44 by a sealing unit 101.

The support arrangement interior 98 comprises a first region 102, which, in particular with regard to its axial extent, is substantially formed in the rotatable support arrangement part 46 and is delimited between the housing parts 48, 50 of the same. The two drive gears 66, 94 and the driven gears 681, 682 are also contained in the first region 102 of the support arrangement interior 98.

The support arrangement interior 98 comprises a second region 104, which, in particular with regard to its axial extent, is substantially formed in the fixed support arrangement part 44 and is delimited radially outwards by the housing part 54 of the same and axially by the end cover 56 supporting the imbalance motor 58. On the second ring gear element 90, which is firmly supported on the housing part 54, a disc-like limiting element 106 having a lubricant passage opening 108, for example concentric to the roller axis of rotation W, is supported at the axial end thereof facing the first region 102 of the support arrangement interior 98.

In the support arrangement 42, a first lubricant sump 110 is formed substantially in the first region 102 of the support arrangement interior 98 and a second lubricant sump 112 is formed substantially in the second region 104 of the support arrangement interior 98. When the ground processing roller 22 is not rotating and the unbalanced masses $\mathbf{30}_1$, $\mathbf{30}_2$ are not driven to rotate, the first lubricant sump 110 contains lubricant up to a first lubricant sump level $N_1$. Due to gravity, the first lubricant sump level $N_1$, which is fundamentally located in the height direction H below the roller axis of rotation W, has a first distance $D_1$ in the height direction H from the roller axis of rotation W.

The second lubricant sump 112 has a second lubricant sump level $N_2$, which is substantially defined by the lubricant passage opening 108, which substantially also provides an overflow connection 114, or its region which has the greatest distance to the roller axis of rotation W in the downward height direction H. As FIG. 4 clearly shows, this distance $D_2$ of the second lubricant sump level $N_2$ is smaller than the distance $D_1$ of the first lubricant sump level to the roller axis of rotation W. Since, apart from the lubricant passage opening 108 which substantially provides the overflow connection 114, there is no flow connection between the second lubricant sump 112 and the first lubricant sump 110, the second lubricant sump 112 is substantially always filled with lubricant up to the second lubricant sump level $N_2$ or to the lowest region of the lubricant passage opening 108 in the height direction H.

During rotational operation of the ground processing roller 22 and in particular also when unbalanced masses $\mathbf{30}_1$, $\mathbf{30}_2$ are driven to rotate, the unbalanced masses $\mathbf{30}_1$, $\mathbf{30}_2$ arranged at a radial distance from the roller axis of rotation W and the driven gears 681, 682 connected to them for common rotation move successively into the area of the first lubricant sump 110 or through the same. Not only are the areas of the driven gears 681, 682 moving through the first lubricant sump 110 or the unbalanced masses $\mathbf{30}_1$, $\mathbf{30}_2$ driven by them moved into or through the first lubricant sump 110 and thereby wetted with lubricant, but, due to the rotation in particular of the driven gears 681, 682, lubricant from the first lubricant sump 110 is thrown substantially into the entire volume of the first region 102 of the support arrangement interior 98 and in particular upwards in the height direction H. Due to the contact with the driven gears 681, 682, the drive gears 66, 94 which are in meshing engagement with the driven gears 681, 682 also contribute to the fact that lubricant flows into the first region 102 of the support arrangement interior 98 and in particular is also thrown upward in the height direction H. The driven gears 681, 682 moving through the first lubricant sump 110 and possibly also the drive gears 66, 94 thus substantially form a lubricant conveying arrangement 116, through which lubricant from the first lubricant sump 110 is distributed in the first region 102 of the support arrangement interior 98 and is conveyed upwards in the height direction H, as indicated by arrows in FIG. 4.

Figure 5:
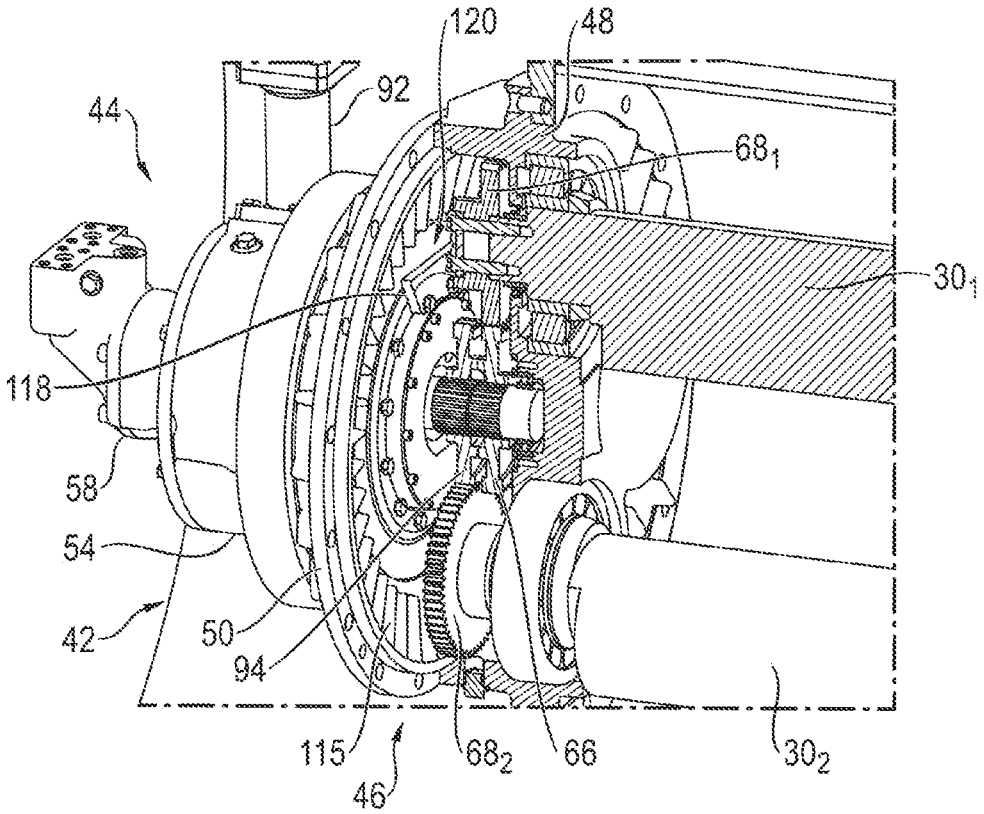
FIG. 5 is a perspective, partially sectional partial view of the ground processing roller of FIG. 2.
Figure 6:
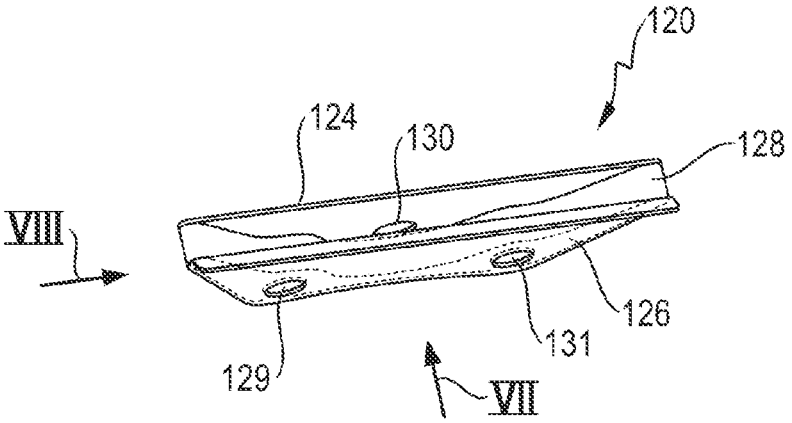
FIG. 6 is a perspective view of a lubricant collecting element of the ground processing roller of FIG. 2.
Figure 7:
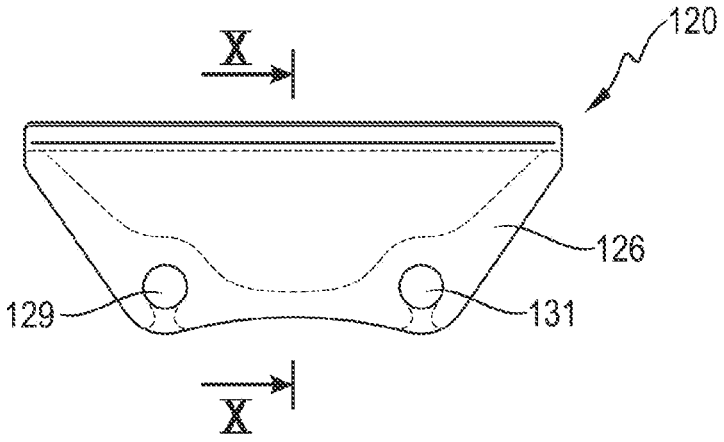
FIG. 7 is a front view of the lubricant collecting element of FIG. 6 in viewing direction VII in FIG. 6.
Figure 8:
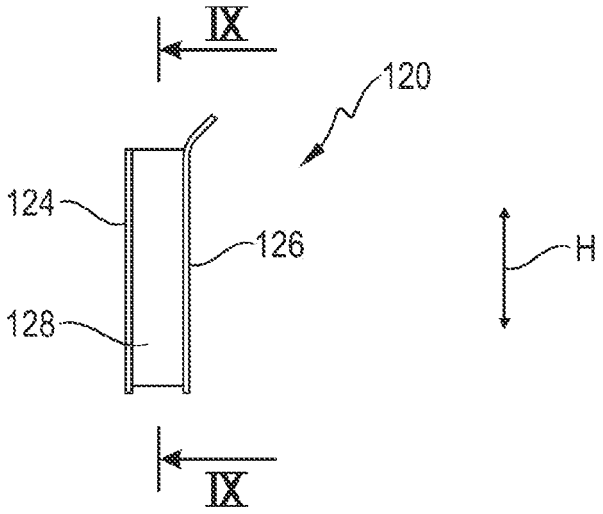
FIG. 8 is a side view of the lubricant collecting element of FIG. 6 in viewing direction VIII in FIG. 6.

To distribute lubricant substantially throughout the entire volume of the first region 102 of the support arrangement interior 98, there can also be provided conveying projections 115 which act as conveyor blades, follow one another in the circumferential direction and extend approximately radially, as can be seen in FIG. 5 on the side of the component 50 of the rotating support arrangement part 46 facing the first region of the support arrangement interior 98. When the ground processing roller 22 rotates, the conveying projections 115 move through the first lubricant sump 110 and thereby take lubricant upwards, which then drips down from above onto components lying above the first lubricant sump 110. These conveying projections 115, which also contribute to increased heat dissipation, thus form part of the lubricant conveying arrangement 116.

A lubricant collecting unit, generally designated 118, is arranged on the fixed support arrangement part 44, in particular the housing part 54 thereof, in an area lying above the roller axis of rotation W in the height direction H. This comprises a lubricant collecting element 120, which is described in more detail below with reference to FIGS. 6 to 10 and can for example be fixed to the housing part 50; it is substantially open at the top in the height direction H and can collect lubricant that accumulates in the upper part of the first region 102 of the support arrangement interior 98 or is dripping down from there. Via a channel-like lubricant flow connection 122 formed in particular in the housing part 54 of the fixed support arrangement part 44 and, for example, also in the second ring gear element 90, the lubricant collected by the lubricant collecting element 120 gets into the second region 104 of the support arrangement interior 98 and thus into the second lubricant sump 112 substantially formed therein.

If, in the standstill state, the first lubricant sump 110 is filled with lubricant up to the first lubricant sump level $N_1$, the level of the first lubricant sump 110 drops below the first lubricant sump level $N_1$ present in the standstill state in rotational operation due to the fact that lubricant is also thrown into the upper part of the first region 102 of the support arrangement interior 98 and is partially injected via the lubricant flow connection 122 into the second region 104 of the support arrangement interior 98, but not to such an extent that sufficient wetting of components of the lubricant conveying arrangement 116 moving through the first lubricant sump 110 were no longer possible. However, the fill level of the second lubricant sump 112 always substantially corresponds to the second lubricant sump level $N_2$.

In working operation, i.e. when the ground processing roller 22 and in particular also the unbalanced masses $\mathbf{30}_1$, $\mathbf{30}_2$ rotate, components of the unbalance transmission unit 72, which is accommodated substantially in the second region 104 of the support arrangement interior 104, move through the second lubricant sump 112. This applies in particular to the two ring gears 84, 88, the planet gear support 78 and the planet gears 80, 82 rotatably supported thereon. As a result, all areas of the unbalance transmission unit 72 successively come into contact with the lubricant present in the second lubricant sump 112. The sun gears 70, 76 are also wetted with lubricant through contact with the planet gears 80, 82.

The continuous conveying of lubricant by means of the lubricant conveying arrangement 116 from the first lubricant sump 110 into the second lubricant sump 112 ensures that the portion of the lubricant conveyed into the second region 104 of the support arrangement interior 98, which would lead to the second lubricant level $N_2$ being exceeded, leads to a permanent outflow of lubricant from the second lubricant sump 112 or the second region 104 of the support arrangement interior 98 via the overflow connection 114 or the lubricant passage opening 108 into the first lubricant sump 110. Thus, a lubricant circulation is established in which the conveying or centrifugal effect of the drive gears 66, 94, the driven gears 681, 682, 683 and the conveying projections 115 ensures that all components present in the first region 102 of the support arrangement interior 98, in particular the unbalance transmission system 96, are wetted with lubricant. This particularly applies to the bearing units present in this region and used to mount rotating system components. Part of this lubricant distributed in the first region 102 of the support arrangement interior 98 reaches the second region 104 of the support arrangement interior 98 and the second lubricant sump 112 provided there via the lubricant collecting element 120 and the lubricant flow connection 122 and thus serves to sufficiently lubricate the unbalance transmission unit 72 in particular. Due to the cascade-like arrangement of the two lubricant sumps 110, 112, it is ensured that lubricant can be reliably distributed to components positioned at significantly different levels in the height direction H or moving in these regions.

The substantially trough-like lubricant collecting element 120 shown in FIGS. 6 to 10 has two end walls 124, 126 and a bottom wall element 128 arranged therebetween in the illustrated embodiment. The bottom wall element 128 closes the lubricant collecting element 120, which is basically open at the top, in the height direction H, in the height direction H downwards or also in the lateral direction. The end walls 124, 126 and the bottom wall element 128 can be held together, for example, by screw bolts passing through openings 129, 131 and fixing the lubricant collecting element 120 on the housing part 50.

A passage opening 130 is formed in the end wall 124 to be positioned adjacent to the fixed support arrangement part 44, through which passage opening lubricant collected in the lubricant collecting element 120 can flow into the lubricant flow connection 122. It should be noted that, with an appropriate structural design, the end wall 124 can also be provided directly by the fixed support arrangement part 44, or/and that the lubricant collecting element 120 can also be constructed in one piece, for example as a cast element.

To be able to achieve an improved collecting effect for the lubricant collecting element 120 with a comparatively compact design, the end wall 126, which is further away from the fixed support arrangement part 44, can extend upwards in its area extending beyond the bottom wall element 128 in the height direction H be bent away from the fixed support arrangement part 44 to further support the funnel-like design of the lubricant collecting element 120.

Finally, it should be pointed out that in the support arrangement 42, as can be seen in particular in FIG. 4, openings closed by end members 132 can be formed in various regions, via which openings lubricant can be filled into the support arrangement interior 98 or drained therefrom.

The invention claimed is:

1. A ground processing roller comprising:

a roller shell that can be rotated about a roller axis of rotation and surrounds a roller interior;

an unbalance arrangement with a plurality of unbalanced masses arranged at a circumferential distance from one another about the roller axis of rotation, wherein each unbalanced mass can be driven to rotate about a respective unbalance axis of rotation;

an unbalance drive with an unbalance motor and an unbalance transmission system, wherein the unbalance transmission system comprises at least one drive gear that can be driven for rotation by the unbalance motor and, in assignment to each unbalanced mass, a driven gear connected thereto for common rotation, wherein each drive gear is coupled to at least one driven gear for torque transmission;

a first lubricant sump arranged in a height direction below the roller axis of rotation, wherein the first lubricant sump is filled or fillable with lubricant up to a first lubricant sump level which has a first distance from the roller axis of rotation in the height direction;

a second lubricant sump arranged in a height direction below the roller axis of rotation, wherein the second lubricant sump is filled or fillable with lubricant up to a second lubricant sump level which has a second distance from the roller axis of rotation in the height direction, wherein the second distance is smaller than the first distance;

a lubricant conveying arrangement for conveying lubricant from the first lubricant sump into the second lubricant sump; and an overflow connection between the first lubricant sump and the second lubricant sump, wherein lubricant flows from the second lubricant sump via the overflow connection into the first lubricant sump in the conveying operation of the lubricant conveying arrangement when the second lubricant sump level in the second lubricant sump is reached or/and exceeded.

2. The ground processing roller as claimed in claim 1, wherein at least one drive gear is in meshing engagement with at least one driven gear or/and at least one driven gear of the at least one driven gear is connected to a respective unbalance mass of the plurality of unbalanced masses assigned to at least one driven gear for common rotation about the unbalance axis of rotation of the respective unbalance mass, or/and in that the unbalance axis of rotation of at least one unbalanced mass is eccentric or/and parallel to the roller axis of rotation.

3. The ground processing roller as claimed in claim 1, wherein a lubricant collecting unit which is open at the top in the height direction is provided above the roller axis of rotation in the height direction, and in that a lubricant flow connection is provided between the lubricant collecting unit and the second lubricant sump for directing lubricant collected in the lubricant collecting unit into the second lubricant sump.

4. The ground processing roller as claimed in claim 3, wherein the lubricant collecting unit comprises a trough-like lubricant collecting element, which preferably widens like a funnel in the height direction.

5. The ground processing roller as claimed in claim 1, wherein the roller shell is rotatably supported on a support arrangement about the roller axis of rotation, wherein the support arrangement has a rotatable support arrangement part which is non-rotatably connected to the roller shell and a rotatable support arrangement part rotatably supporting the fixed support arrangement part, wherein the first lubricant sump and the second lubricant sump are provided in a support arrangement interior formed in the support arrangement.

6. The ground processing roller as claimed in claim 5, wherein the first lubricant sump is substantially completely provided in the rotatable support arrangement part, or/and in that the second lubricant sump is substantially completely provided in the fixed support arrangement part.

7. The ground processing roller as claimed in claim 5, wherein the unbalanced masses are supported on the rotatable support arrangement part such that they can rotate about their respective unbalanced axes of rotation.

8. The ground processing roller as claimed in claim 1, wherein the at least one drive gear and the driven gears are arranged in a first region of the support arrangement interior formed substantially in the rotatable support arrangement part.

9. The ground processing roller as claimed in claim 8, wherein the first lubricant sump is substantially completely provided in the rotatable support arrangement part, or/and in that the second lubricant sump is substantially completely provided in the fixed support arrangement part, and a driven gear of the driven gears positioned in the height direction below the roller axis of rotation is at least partially positioned in the first lubricant sump.

10. The ground processing roller as claimed in claim 5, wherein a lubricant collecting unit which is open at the top in the height direction is provided above the roller axis of rotation in the height direction, and in that a lubricant flow connection is provided between the lubricant collecting unit and the second lubricant sump for directing lubricant collected in the lubricant collecting unit into the second lubricant sump, and the lubricant collecting unit is provided on the fixed support arrangement part, and the lubricant flow connection is formed in the fixed support arrangement part or/and is formed substantially in the second region of the support arrangement interior formed in the fixed support arrangement part.

11. The ground processing roller as claimed in claim 10, wherein a limiting element delimiting the second lubricant sump in the direction of the roller axis of rotation is provided on the fixed support arrangement part, and in that at least one lubricant passage opening of the overflow connection is provided in the limiting element.

12. The ground processing roller as claimed in claim 11, wherein the roller axis of rotation passes through the lubricant passage opening, or/and in that the lubricant passage opening is arranged substantially concentrically to the roller axis of rotation.

13. The ground processing roller as claimed in claim 1, wherein the unbalance transmission system can comprise two drive gears and an unbalance transmission unit, wherein at least one of the drive gears can be driven to rotate by the unbalance motor via the unbalance transmission unit.

14. The ground processing roller as claimed in claim 13, wherein one of the drive gears can be driven by the unbalance motor via the unbalance transmission unit to rotate about a drive gear axis of rotation that is preferably concentric with the roller axis of rotation, and another of the drive gears can be driven directly by the unbalance motor to rotate about the drive gear axis of rotation.

15. The ground processing roller as claimed in claim 14, wherein the unbalance transmission unit can be configured as a rotational position adjustment gear, wherein the unbalance transmission unit can adjust a rotational position of the one of the drive gears about the drive gear axis of rotation with respect to a rotational position of the other of the drive gears about the drive gear axis of rotation.

16. The ground processing roller as claimed in claim 13, wherein the roller shell is rotatably supported on a support arrangement about the roller axis of rotation, wherein the support arrangement has a rotatable support arrangement part which is non-rotatably connected to the roller shell and a rotatable support arrangement part rotatably supporting the fixed support arrangement part, wherein the first lubricant sump and the second lubricant sump are provided in a support arrangement interior formed in the support arrangement, and the unbalance transmission unit is arranged in the second region of the support arrangement interior which is substantially formed in the fixed support arrangement part.

17. The ground processing roller as claimed in claim 16, wherein the first lubricant sump is substantially completely provided in the rotatable support arrangement part, or/and in that the second lubricant sump is substantially completely provided in the fixed support arrangement part, and a part of the unbalance transmission unit positioned in the height direction below the roller axis of rotation is at least partially positioned in the second lubricant sump.

18. The ground processing roller as claimed in claim 1, wherein the lubricant conveying arrangement comprises at least one driven gear, or/and at least one drive gear.

19. The ground processing roller as claimed in claim 6, wherein the lubricant conveying arrangement comprises a plurality of conveying projections provided on the rotatable support arrangement part.

20. A ground processing machine comprising at least one ground processing roller as claimed in claim 1.

* * * * *